US007770260B2

(12) United States Patent
Fumalle

(10) Patent No.: US 7,770,260 B2
(45) Date of Patent: Aug. 10, 2010

(54) DEVICE FOR BLOCKING AN ARTICULATION AXIS IN THE HOUSING OF A CROWN MEMBER, SUCH AS A GRID OR A BUFFER, IN A ROAD PORTHOLE

(75) Inventor: Christian Fumalle, Butry (FR)

(73) Assignee: Norinco, Saint Crepin Ibouvillers (FR)

( * ) Notice: Subject to any disclaimer, the term of this patent is extended or adjusted under 35 U.S.C. 154(b) by 0 days.

(21) Appl. No.: 12/302,316

(22) PCT Filed: Jun. 27, 2007

(86) PCT No.: PCT/FR2007/051542

§ 371 (c)(1),
(2), (4) Date: Feb. 6, 2009

(87) PCT Pub. No.: WO2008/017770

PCT Pub. Date: Feb. 14, 2008

(65) Prior Publication Data

US 2009/0178239 A1 Jul. 16, 2009

(30) Foreign Application Priority Data

Jul. 5, 2006 (FR) ..... 06 52815

(51) Int. Cl.
*E05D 7/10* (2006.01)

(52) U.S. Cl. ..... 16/254; 16/270; 16/324; 16/348; 404/25; 403/116

(58) Field of Classification Search ..... 16/254, 16/270, 324, 327, 349, 250, 348; 52/20; 137/371; 404/25; 49/386; 403/116; 220/220
See application file for complete search history.

(56) References Cited

U.S. PATENT DOCUMENTS

| | | | | |
|---|---|---|---|---|
| 5,394,650 | A * | 3/1995 | Dean | 49/386 |
| 7,216,459 | B1 * | 5/2007 | Akkala et al. | 52/20 |
| 7,341,398 | B2 * | 3/2008 | Johnson et al. | 404/25 |
| 2006/0134999 | A1 | 6/2006 | Tievant et al. | |
| 2008/0063471 | A1 * | 3/2008 | Veldboom et al. | 404/25 |

FOREIGN PATENT DOCUMENTS

| | | |
|---|---|---|
| EP | 1 662 052 A1 | 5/2006 |
| FR | 2 724 687 A1 | 3/1996 |
| GB | 2 192 654 A | 1/1988 |
| WO | WO 02/059425 A1 | 8/2002 |

* cited by examiner

*Primary Examiner*—William L. Miller
(74) *Attorney, Agent, or Firm*—Leydig, Voit & Mayer, Ltd.

(57) ABSTRACT

A device holding captive a hinge pin in a housing of a cover element, such as a grate or a lid, of a manhole. The device has a cotter pin attached in a removable manner to the cover element to axially retain a hinge pin in a housing of the element against a restoring force of an elastic component inserted between the pin and the bottom of the housing. The invention can be applied to roadway equipment.

9 Claims, 2 Drawing Sheets

DEVICE FOR BLOCKING AN ARTICULATION AXIS IN THE HOUSING OF A CROWN MEMBER, SUCH AS A GRID OR A BUFFER, IN A ROAD PORTHOLE

FIELD OF THE INVENTION

The present invention relates to a device for holding captive at least one hinge pin in a joint housing of a cover element, such as a grate or a lid, mounted and articulated on a support frame by an intermediary of the pin.

The articulation of such a cover element on a frame does not allow removal or extraction of the cover element from the frame.

BACKGROUND

According to prior art, installation with a non-removable articulated assembly of the cover element to a support frame consisted of setting, just before positioning of the cover element on the frame, at least one hinge pin in a housing in a side of the cover element, near an edge, for articulation to the frame, and parallel to the edge. Once the cover element was positioned on the frame, an operator poured resin into the housing of the hinge pin, pushing the hinge pin partially back, out of the housing, and introducing the hinge pin into a strike plate of the frame that could consist of a blind hole. Once the resin hardened, removal of the hinge pin from the frame became impossible.

Such an assembly has the major disadvantage that the hinge pin can come out of the cover element housing when handling the cover element to position it on the support frame, at the risk of losing the hinge pin.

SUMMARY OF THE INVENTION

The present invention aims to eliminate the above disadvantage by providing a device that keeps the hinge pin captive within the housing of the cover element.

To this effect, according to the invention, the device holds at least one hinge pin captive within a joint housing of a cover element, such as a grate or a lid to be mounted and articulated on a support frame by the pin. The device has a cotter pin attached in a removable manner in a hole of the cover element, transversely with respect to the housing of the hinge pin, in such a way as to axially retain the pin in the housing against the restoring force of an elastic component that is mounted pre-stressed in the housing, between the bottom of the housing and the end of the pin, opposite the end bearing on the transverse retaining cotter pin.

Preferably, the elastic return component is a helical compression spring mounted coaxially in the housing with respect to the hinge pin.

The hinge pin has a length such that after withdrawal of the cotter pin, the hinge pin partially projects from the cover element under the action of the restoring force of the elastic component.

The hinge pin is advantageously cylindrical.

The cover element can have a rectangular shape, and the housing of the hinge pin is then realized in a side of the cover element, parallel to the corresponding articulation edge of the cover element, and in the vicinity of the edge.

The housing of the hinge pin and the hole of the cover element are made by casting.

The invention also relates to a cover element such as a grate or a lid, for a manhole in particular, including the device.

The invention moreover relates to a process for installation of a cover element, such as a grate or a lid, mounted and articulated on a support frame, the cover element including the device. The method includes positioning the cover element on the frame with the hinge pin held captive within the cover element housing, and withdrawing the cotter pin from the cover element to enable the elastic component to push the pin partially back out of the housing and introduce the pin coaxially into a blind hole forming a strike plate in the frame.

BRIEF DESCRIPTION OF DRAWING FIGURES

The invention will be better understood and other aims, characteristics, details and advantages of it will appear more clearly in the following explanatory description in reference to the appended drawings given only by way of example, illustrating an embodiment of the invention, whereby:

DETAILED DESCRIPTION

Figure 1:
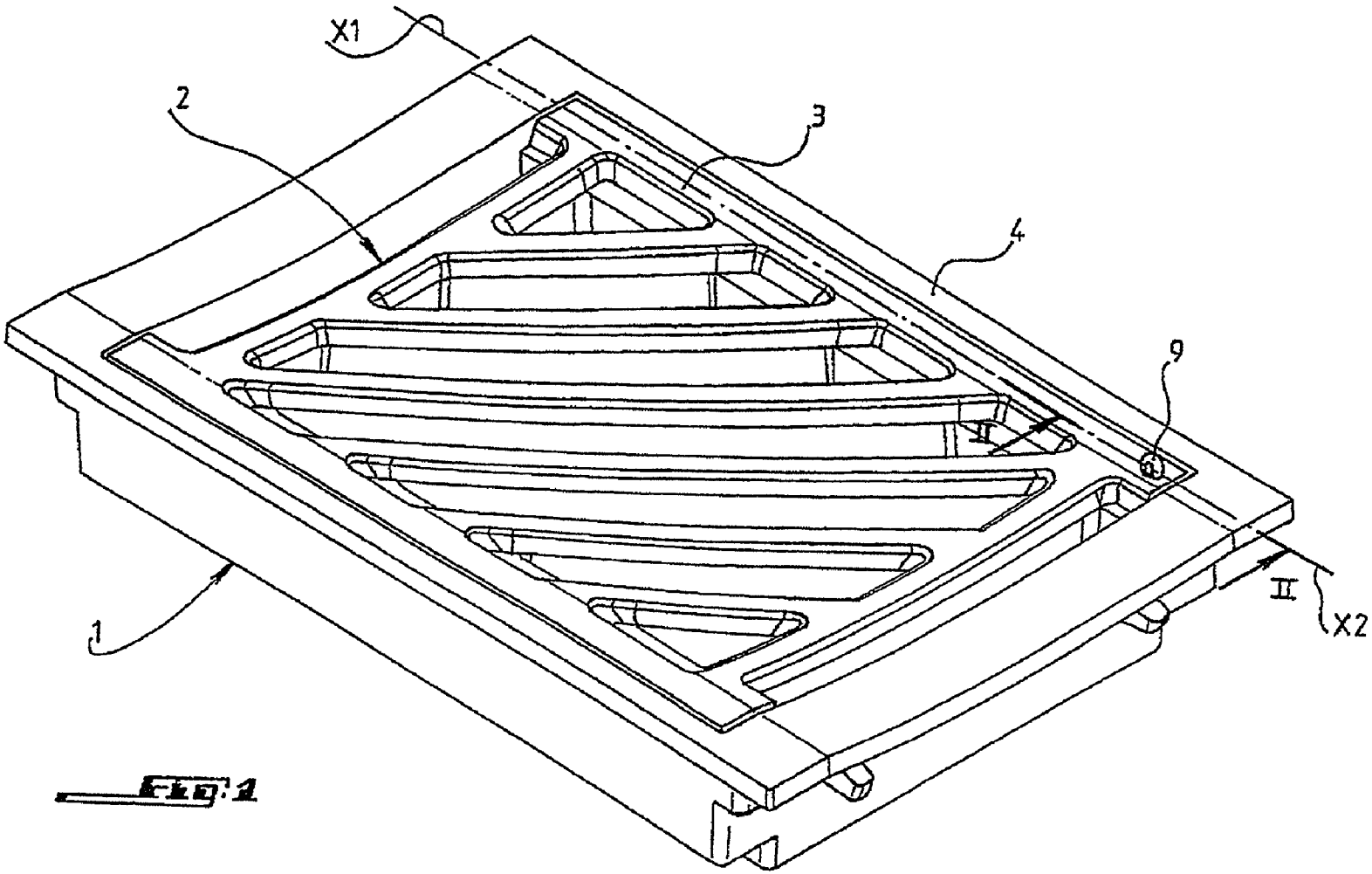
FIG. 1 is a perspective view of a cover element mounted and articulated on a support frame.
Figure 2:
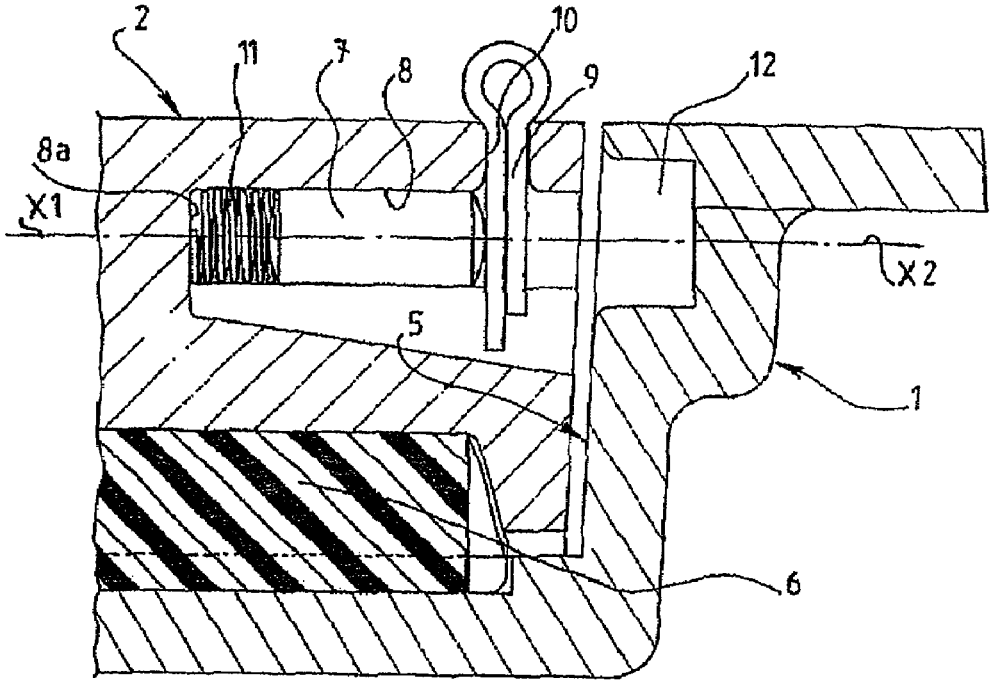
FIG. 2 is an enlarged view in section, taken along line II-II of FIG. 1, and representing the device of the invention for retention of a hinge pin in the cover element.
Figure 3:
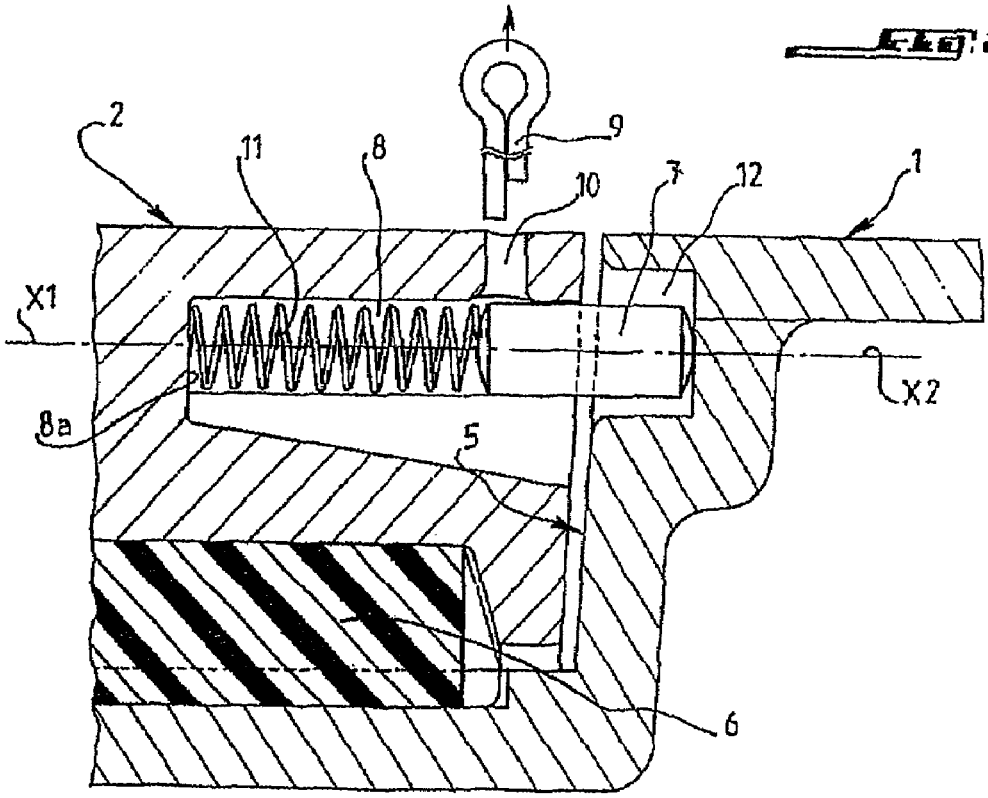
FIG. 3 is a view in section, similar to that of FIG. 2, and representing the hinge pin released for articulation of the cover element to the frame.

Referring to the figures, reference 1 designates a frame that has a rectangular shape and on which a cover element 2 is articulated. The cover element 2, in this case, consists of a grate, with it well understood that cover element 2 can consist of a cover or lid.

The frame 1 is sunk into the pavement in such a way that the cover element 2 allows the closing of a manhole.

The eEdge 3 of the cover element 2 is mounted and articulated to a corresponding edge 4 of the frame 1 according to an articulation axis X1, X2 extending parallel to edges 3, 4.

The articulation of the cover element 2 to the frame 1 does not allow removal or extraction of element 2 from the frame.

The cover element 2, in its position for closing the frame 1, is housed in a recess 5 of the frame 1 and can rest on a peripheral joint 6, housed in the recess, to reduce the noise of fitting element 2 in the frame.

According to the invention, the articulated fitting of the cover element 2 into the frame 1, the cover element 2 including at least one cylindrical hinge pin 7 held captive in a joint housing 8 in the cover element 2 and opening on one side of the cover element.

A housing 8 is located in the articulation edge 3 of the element 2, from the side of the element extending parallel to the edge and coaxially with respect to the articulation axis X1, X2.

A hinge pin 7 is held captive in the housing 8 by a cotter pin 9 attached in a removable manner in a hole 10 of the cover element 2 and perpendicular to the longitudinal axis of the housing 8, the cotter pin 9 thus passing through the housing.

The cotter pin 9 exerts an axial force on an end of the pin 7 such that the opposite end of the pin 7 compresses a helical compression spring 11 between that end and a bottom 8*a* of housing 8.

The cotter pin 9 partially projects from the upper surface of the articulation edge of the cover element 2 so that it can be grasped and manually withdrawn from the element.

Preferably, the housing 8 and the hole 10 of the cover element 2 are made by casting.

With the cotter pin 9 holding the hinge pin 7 captive in the housing 8 of the cover element 2, the cover element can be stored and/or handled without risk of losing the hinge pin 7.

The end of the articulation edge 3 of the cover element 2 opposite the holding hinge pin 7 captive in the housing 8 is articulated in a conventional manner to the frame 1 by a hinge pin connected, coaxially with respect to the pin 7, either with the end of the articulation edge 3 or with the corresponding edge of the frame 1, so that the pin can engage freely, during fitting of the cover element 2 onto the frame 1, in a strike plate on the edge of the frame 1 or on the end of the articulation edge 3 of the element 2.

The fitting of the articulation of the cover element 2 onto the frame 1 already emerges from the preceding description and will now be explained.

First, an operator grasps the cover element 2 in order to position it on the frame 1, while introducing the hinge pin of the element 2, on the opposite side from the captive hinge pin 7, into the corresponding strike plate of the frame 1 or of the end of the articulation edge 3, and he then positions element 2, completely supported in the recess 5 of the frame 1, as represented in FIG. 1.

Then, the operator manually, with a tool if necessary, withdraws the cotter pin 9 from the cover element 2 to release the pin 7 that, under the action of the restoring force of the spring 11, partially comes out of the housing 8 to automatically engage in the corresponding strike plate 12 of the frame 1, with the strike plate 12 possibly consisting of a blind hole.

In this way, the articulation of the cover element 2 to the frame 1 is rendered unremovable to prevent extraction of the element 2 from the frame.

The device of the invention has a very simple and inexpensive design since it uses commercial components.

The invention claimed is:

1. A device for holding captive, within a housing of a cover element, at least one hinge pin, the cover element being mounted on and articulatable with respect to a support frame, the device comprising:

a cotter pin removably inserted into a hole of the cover element, transverse with respect to the hinge pin, to axially retain the hinge pin in the housing of the cover element; and an elastic component that is pre-stressed and that is located in the housing, between a bottom wall of the housing and a first end of the hinge pin, the first end being opposite a second end of the hinge pin, the second end of the hinge pin bearing on the cotter pin that retains the hinge pin in the housing against a restoring force applied to the hinge pin by the elastic component.

2. The device according to claim 1, wherein the elastic component is a helical compression spring mounted in the housing and coaxial with the hinge pin.

3. The device according to claim 2, wherein the hinge pin has a length such that, after withdrawal of the cotter pin, the hinge pin partially projects from the cover element in response to the restoring force applied by the elastic component.

4. The device according to claim 1, wherein the hinge pin has a length such that, after withdrawal of the cotter pin, the hinge pin partially projects from the cover element in response to the restoring force applied by the elastic component.

5. The device according to claim 1, wherein the hinge pin is cylindrical.

6. The device according to claim 1, wherein the cover element has a rectangular shape, and the housing of the hinge pin is in a side of the cover element that is parallel to a corresponding articulation edge of the cover element and proximate the articulation edge.

7. The device according to claim 1, wherein the housing of the hinge pin, which includes the hole of the cover element, is made by casting.

8. A coverer assembly for selectively covering a manhole, the assembly including:

a cover element; and a device for holding captive, within a housing of the cover element, at least one hinge pin, the cover element being mounted on and articulatable with respect to a support frame, the device comprising:

a cotter pin removably inserted into a hole of the cover element, transverse with respect to the hinge pin, to axially retain the hinge pin in the housing of the cover element; and an elastic component that is pre-stressed and that is located in the housing, between a bottom wall of the housing and a first end of the hinge pin, the first end being opposite a second end of the hinge pin, the second end of the hinge pin bearing on the cotter pin that retains the hinge pin in the housing against a restoring force applied to the hinge pin by the elastic component.

9. A method for installing a cover element, articulated on a support frame, the cover element including a device for holding captive, within a housing of the cover element, at least one hinge pin, the cover element being mounted on and articulatable with respect to the support frame, the device comprising a cotter pin removably inserted into a hole of the cover element, transverse with respect to the hinge pin, to axially retain the hinge pin in the housing of the cover element, and an elastic component that is pre-stressed and that is located in the housing, between a bottom wall of the housing and a first end of the hinge pin, the first end being opposite a second end of the hinge pin, the second end of the hinge pin bearing on the cotter pin that retains the hinge pin in the housing against a restoring force applied to the hinge pin by the elastic component, the method comprising:

positioning the cover element on the frame with the hinge pin held captive within the housing of the cover element; and withdrawing the cotter pin from the cover element so the elastic component pushes the hinge pin partially out of the housing and introduces the hinge pin coaxially into a blind hole of a strike plate in the support frame.

* * * * *